United States Patent [19]

Lasater

[11] 4,199,012

[45] Apr. 22, 1980

[54] LIQUID DISPENSING NOZZLE HAVING VAPOR RECOVERY ARRANGEMENT

[75] Inventor: Donald A. Lasater, Fairfield, Ohio

[73] Assignee: Dover Corporation, New York, N.Y.

[21] Appl. No.: 849,498

[22] Filed: Nov. 7, 1977

Related U.S. Application Data

[63] Continuation of Ser. No. 734,522, Oct. 21, 1976, abandoned, which is a continuation of Ser. No. 567,597, Apr. 14, 1975, abandoned, which is a continuation of Ser. No. 394,184, Sep. 4, 1973, abandoned.

[51] Int. Cl.[2] ..... B65B 3/18

[52] U.S. Cl. ..... 141/52; 141/59

[58] Field of Search ..... 141/59, 93, 290, 52, 141/285, 392

[56] References Cited

U.S. PATENT DOCUMENTS

| | | | |
|---|---|---|---|
| 3,826,291 | 7/1974 | Steffens | 141/59 |
| 3,881,894 | 5/1975 | Onufer | 141/93 X |

*Primary Examiner*—Frederick R. Schmidt

*Attorney, Agent, or Firm*—Kinney and Schenk

[57] ABSTRACT

A liquid dispensing nozzle has a spout formed of inner and outer concentric cylindrical tubes. Liquid is dispensed from the nozzle through the inner tube to a tank to be filled. Vapors within the tank are returned through an annular passage, which is between the inner and outer tubes, to vapor recovery means by a vacuum pump. The vacuum pump exerts a sufficient suction to pull not only the vapors within the tank but also some air from the atmosphere through the fill pipe in which the spout is inserted so as to insure that no vapor escapes to the atmosphere.

8 Claims, 2 Drawing Figures

LIQUID DISPENSING NOZZLE HAVING VAPOR RECOVERY ARRANGEMENT

The present application is a continuation of application Ser. No. 734,522, filed Oct. 21, 1976 now abandoned which was a continuation of Ser. No. 567,597, filed Apr. 14, 1975 now abandoned which was a continuation of Ser. No. 394,184, filed Sept. 4, 1973 now abandoned.

When filling a vehicle tank with gasoline through a dispensing nozzle, vapors from the gasoline within the tank escape therefrom through the fill pipe opening in which the spout of the nozzle is inserted. This escape of the vapors into the atmosphere pollutes the air. While the vapor volume from filling a single vehicle is relatively small, a large number of vehicles receiving gasoline at a service station results in a substantial quantity of gasoline vapors escaping into the atmosphere. Thus, pollution of the atmosphere can be decreased if the vapor resulting from filling of vehicle tanks with gasoline can be eliminated.

Various arrangements have been proposed for use with a liquid dispensing nozzle to prevent the escape of gasoline vapor into the atmosphere. These arrangements have employed a seal to seal the fill pipe opening.

The present invention contemplates an arrangement in which it is not necessary to seal the fill pipe to prevent the escape of vapors into the atmosphere. Thus, the present invention eliminates the requirement of an arrangement in which it is necessary for automatic shutoff of the flow to occur if pressure within the tank exceeds a predetermined pressure since the tank is not sealed. Accordingly, the present invention not only eliminates the requirement for sealing means but also eliminates the requirement for a device to sense the pressure in the tank being filled to insure that it does not exceed a predetermined pressure.

The present invention meets these requirements through utilizing an arrangement in which all of the vapors are sucked from the tank along with some air from the atmosphere to insure that no vapor escapes to the atmosphere. This is preferably accomplished by utilizing a vacuum pump to create the desired suction in the tank being filled.

An object of this invention is to provide a liquid dispensing nozzle having an improved arrangement to recover vapor of the liquid dispensed into a tank by the nozzle.

Another object of this invention is to provide a liquid dispensing nozzle in which vapors are prevented from escaping to the atmosphere through the fill pipe of the tank being filled by the nozzle without sealing of the fill pipe.

Other objects, uses, and advantages of this invention are apparent upon a reading of this description, which proceeds with reference to the drawings forming part thereof and wherein.

Figure 1:
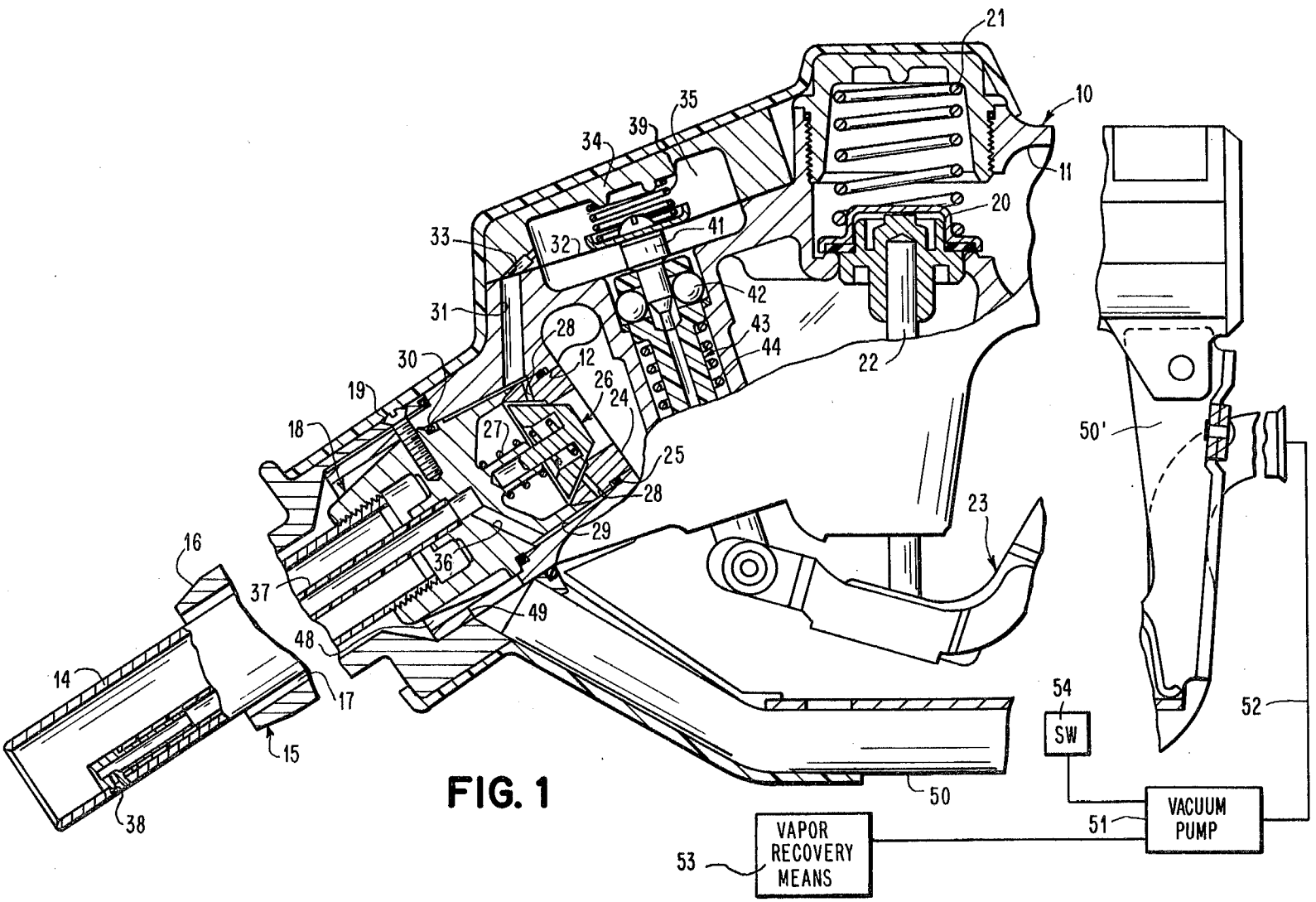
FIG. 1 is a sectional view, partly in elevation, of a nozzle having the vapor recovery arrangement of the present invention with a portion shown schematically.

Referring to the drawings and particularly FIG. 1, there is shown a nozzle body 10 having an inlet 11 to which a hose is connected to supply liquid such as gasoline, for example, to the interior of the body. The body

10 has an outlet 12 with which an inner cylindrical tube 14 of a spout 15 communicates to receive liquid from the interior of the body 10.

The spout 15 also includes an outer cylindrical tube 16, which is concentric with the inner tube 14 and spaced therefrom to form an annular passage 17 therebetween. The outer tube 16 of the spout 15 terminates prior to the inner tube 14 of the spout 15.

The inner tube 14 is threaded in the end of a spout adapter 18, which communicates with the outlet 12 of the body 10 so as to enable liquid to flow from the body 10 to the inner tube 14 of the spout 15. The spout adapter 18 is fixed to the body 10 by a screw 19, which also secures the outer tube 16 of the spout 15 to the body 10.

The body 10 has a first or main poppet valve 20 for controlling the flow of liquid from the inlet 11 to the interior of the body 10 and from the interior of the body 10 to the outlet 12. A spring 21 continuously urges the main poppet valve 20 to its closed position in which flow from the inlet 11 to the outlet 12 is stopped or prevented.

A stem 22 is connected to the poppet valve 20 and has its lower portion extending exteriorly of the body 10 in the manner more particularly shown and described in U.S. Pat. No. 3,653,415 to Boudot et al. The valve stem 22 is moved by a manually operated lever or handle 23 in the manner more particularly shown and described in the aforesaid Boudot et al patent.

The spout adapter 18 has a seat ring 24 threaded at its end remote from the inner tube 14 of the spout 15 and disposed within the outlet 12 of the body 10. The seat ring 24 has a sealing ring 25 cooperating therewith to prevent the escape of liquid between the seat ring 24 and the body 10.

A second poppet valve 26 is slidably mounted on the spout adapter 18 and is continuously urged into engagement with the seat ring 24 by a spring 27. Thus, only the pressure of the liquid flowing from the inlet 11 and past the first poppet valve 20 can overcome the spring 27 and move the second poppet valve 26 to an open position.

As the liquid flows between the second poppet valve 26 and the seat ring 24, a venturi effect is created in radially extending passages 28 in the seat ring 24. The outer ends of the passages 28 communicate with an elongated, annular chamber 29, which is formed between the seat ring 24, the spout adapter 18, and the body 10. A sealing ring 30, which is supported in a groove in the spout adapter 18, seals between the spout adapter 18 and the body 10 so that the elongated, annular chamber 29 is sealed by the sealing rings 25 and 30.

The elongated, annular chamber 29 communicates through a passage 31 in the body 10, an opening in a diaphragm 32, and a passage 33 in a cap 34 to a chamber 35, which is formed between the diaphragm 32 and the cap 34. The elongated, annular chamber 29 also communicates through a passage 36 in the spout adapter 18 with a vacuum tube 37, which has one end supported in the spout adapter 18 and the other end communicating with an opening 38 in the inner tube 14 of the spout 15.

Accordingly, as long as the opening 38 is not closed due to the liquid within the tank reaching a predetermined level, which indicates that the tank is filled, the venturi effect created by the flow of the liquid between the seat ring 24 and the second poppet valve 26 draws air through the vacuum tube 37, the passage 36 in the spout adapter 18, the annular chamber 29, and the radially extending passages 28. However, as soon as the opening 38 is blocked, the chamber 35 has its pressure reduced due to the air therein being drawn therefrom because of the venturi effect in the radially extending passages 28 whereby the diaphragm 32 moves upwardly against the force of its spring 39. This venturi effect is more particularly described in U.S. Pat. No. 3,085,600 to Briede.

The diaphragm 32 has a latch retaining pin 41 secured thereto for movement therewith and disposed within three balls 42 (two shown), which are positioned within passages in a latch plunger 43. When the latch retaining pin 41 is in the position shown in FIG. 1, the balls 42 prevent downward movement of the plunger 43, which is slidably mounted within the body 10.

When the diaphragm 32 is moved upwardly because the liquid in the tank reaches the predetermined level at which the tank is deemed to be filled, the latch retaining pin 41 is moved upwardly therewith. The upward movement of the latch retaining pin 41 disposes a tapered portion of the latch retaining pin 41 between the balls 42 whereby the balls 42 may move inwardly to allow the plunger 43 to be moved downwardly against the force of its spring 44. The correlation between the tapered portion of the latch pin 41 and the latch plunger 43 is more specifically shown in U.S. Pat. No. 2,582,195 to Duerr.

The lower end of the latch plunger 43 is connected to the handle 23 as more particularly shown and described in the aforesaid Boudot et al patent. Thus, when the liquid in the tank being filled reaches the predetermined level so that the diaphragm 32 moves upwardly to pull the latch retaining pin 41 upwardly and release the latch plunger 43 from the balls 42, the force of the spring 21 closes the first poppet valve 20 as more particularly shown and described in the aforesaid Boudot et al patent.

Figure 2:
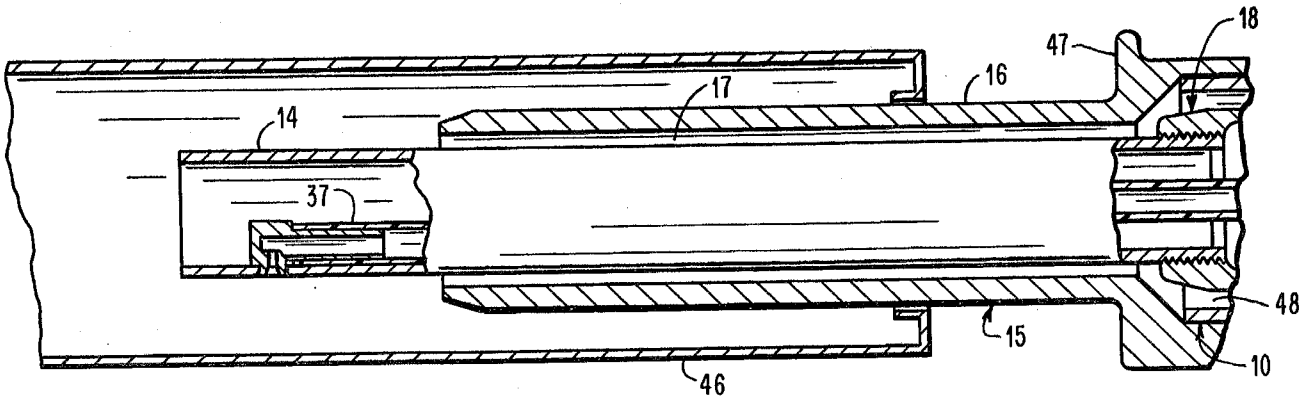
FIG. 2 is a sectional view of a portion of the nozzle of FIG. 1 and showing its spout disposed within the fill pipe of a vehicle tank for supplying liquid thereto.

When the spout 15 is inserted into a fill pipe 46 (see FIG. 2) of a vehicle tank to be filled, the spout 15 is disposed sufficiently within the fill pipe 46 so that the annular passage 17 communicates with the fill pipe 46 and not the atmosphere. The outer tube 16 of the spout 15 is formed with a shoulder 47, which functions as a stop to limit the movement of the spout 15 into the fill pipe 46.

The upper end of the annular passage 17 communicates with an annular chamber 48 (see FIG. 1), which is formed between the spout adapter 18 and the body 10. The annular chamber 48 communicates through a round opening 49 in the body 10 with one end of a passage in a vapor recovery tube 50, which is supported on a nozzle guard 50′ connected to the nozzle body 10. The vapor recovery tube 50 has its passage communicating at its other end with a vacuum pump 51 through a hose 52 whereby the vapors can be sucked from the tank being filled to vapor recovery means 53 such as vapor recovery equipment in which the gasoline vapor can be condensed, for example, so as to be supplied as gasoline again.

Accordingly, with the size of the pump being selected in accordance with the flow rate of the liquid through the nozzle body 10 and the ambient temperature, sufficient suction can be exerted to not only remove all of the vapors from the tank being filled but also to pull some air from the atmosphere to insure that no vapor escapes to the atmosphere. As a result, all of the vapor from the tank being filled can be recovered without any pollution of the atmosphere and any sealing of the fill pipe 46.

Considering the operation of the nozzle of the present invention, the spout 15 is inserted within the fill pipe 46 of the tank to be filled for a sufficient distance so that the annular passage 17 communicates with the interior of the fill pipe 46. As previously mentioned, the shoulder 47 on the outer tube 16 of the spout 15 limits the maximum inward movement of the spout 15 into the fill pipe 46.

The vacuum pump 51 is preferably energized at the time that the nozzle body 10 is removed from its support pedestal. It is necessary for the vacuum pump 51 to be energized no later than when flow starts through the nozzle body 10.

The vacuum pump 51 is energized by the closing of a switch 54. The switch 54 can be closed when the nozzle body 10 is removed from its support pedestal, for example, but no later than when flow starts through the nozzle body 10.

Actuation of the handle 23 opens the first or main poppet valve 20 to allow liquid such as gasoline, for example, to flow through the body 10 and open the second poppet valve 26. The gasoline flows through the second poppet valve 26 and through the spout adapter 18 and the inner tube 14 of the spout 15 to the tank. As long as the tank is not filled, flow continues unless the operator releases the handle 23 to allow the first poppet valve 20 to be closed by the spring 21.

When the liquid in the tank is filled to the level at which the opening 38 is blocked, the suction of the air from the tank through the vacuum tube 37, the passage 36 in the spout adapter 18, and the elongated, annular chamber 29 to the radially extending passages 28 is stopped. As a result, air is evacuated from the chamber 35 through the passage 31 and the passages 28 to create a partial vacuum in the chamber 35 to cause the diaphragm 32 to move upwardly. This automatically causes the main poppet valve 20 to be closed through release of the latch plunger 43.

During this entire time, the vacuum pump 51 continues to exert a suction through the annular passage 17 of sufficient magnitude to draw all of the vapor from the tank being filled and to also suck some air from the atmosphere through the opening in the fill pipe 46 in which the spout 15 is inserted. This insures that the vapor cannot escape to the atmosphere.

If there should by any blocking of the annular passage 17, the annular chamber 48, the opening 49, the passage in the vapor recovery tube 50, or the hose 52, a partial vacuum could not be produced in the tank being filled so that the vapor would escape to the atmosphere. Similarly, if the vacuum pump 51 should fail to be activated, a partial vacuum also could not be produced in the tank being filled.

Accordingly, in areas legally requiring vapor recovery equipment of this type, it would be necessary to employ some type of signal means to indicate to the operator that there has been a blockage of a passage or failure of the vacuum pump 51. In such a situation, the nozzle body 10 could not be employed until the vacuum pump 51 is repaired or the blocked passage opened. However, since the blockage of the vapor recovery passages or the failure of the vacuum pump 51 does not cause a pressure build up in the tank being filled, the operator can complete filling of the tank safely.

An advantage of this invention is that it eliminates the requirement of a mechanism to automatically stop flow of the liquid when the vapor return arrangement is ineffective. Another advantage of this invention is that it avoids sealing of the fill pipe opening so that it can be employed with a nozzle body not having automatic shut-off.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A liquid dispensing nozzle having a body and a spout extending from said body and having its free end for disposition in nonsealing manner in the opening of a fill pipe of a tank or the like, the improvement comprising an inner tube and an outer tube spaced from and concentric with said inner tube, said inner tube and said outer tube defining the spout, said inner tube being in communication with a source of liquid to allow liquid to flow from said body, said outer tube external diameter being less than the inner diameter of the fill pipe thereby permitting air-flow between the inner surface of the fill pipe and the outer surface of said outer tube when each of said inner tube and said outer tube of said spout is disposed in the fill pipe, said inner and outer tubes further defining an annular passage therebetween, vapor return means within said body in communication with one end of said annular passage, the other end of said annular passage extending axially into the fill pipe, vacuum means communicating with said vapor return means to cause air to flow into the fill pipe around the outer surface of the portion of said outer tube within the fill pipe when each of said inner tube and said outer tube of said spout is disposed in the fill pipe to dispense liquid into the tank through said inner tube to form an air seal within the fill pipe thereby preventing vapor escape from the fill pipe into the atmosphere wherein said vacuum means causes all vapor from the tank during filling and air drawn into the fill pipe to exit from the tank fill pipe through said annular passage and said vapor return means to vapor recovery means or the like, separate from the source of liquid.

2. The improvement according to claim 1 in which said vacuum means includes a vacuum pump.

3. The improvement according to claim 1 in which said inner tube extends further into the fill pipe than said outer tube.

4. The nozzle according to claim 1 in which said vacuum means is activated no later than when flow of liquid starts through said body and independently of the flow of liquid through said body.

5. The nozzle according to claim 1 in which said outer tube is secured to said body.

6. The nozzle according to claim 1 including means to cause activation of said vacuum means no later than when flow of liquid starts through said body and independently of the flow of liquid through said body.

7. The nozzle according to claim 6 in which said causing means comprises electrical switch means.

8. The nozzle according to claim 1 including electrical switch means to cause activation of said vacuum means when said body is removed from its support pedestal.

* * * * *